United States Patent [19]

Matsuda

[11] 3,944,827

[45] Mar. 16, 1976

[54] VIRTUAL IMAGE TYPE DOUBLE FOCUSING MASS SPECTROMETER

[75] Inventor: Hisashi Matsuda, Takarazuka, Japan

[73] Assignee: Nihon Denshi Kabushiki Kaisha, Tokyo, Japan

[22] Filed: Aug. 16, 1974

[21] Appl. No.: 498,078

[30] Foreign Application Priority Data

Aug. 21, 1973 Japan ..... 48-93749

[52] U.S. Cl. ..... 250/298; 250/299

[51] Int. Cl.$^2$ ..... B10D 59/44

[58] Field of Search ..... 250/281, 282, 283, 294, 250/296, 298, 299, 396, 397

[56] References Cited

UNITED STATES PATENTS 3,617,741 11/1971 Siegbahn et al. ..... 250/281 X

*Primary Examiner*—Davis L. Willis

*Attorney, Agent, or Firm*—Webb, Burden, Robinson & Webb

[57] ABSTRACT

A virtual image type double focusing mass spectrometer having a diverging electrostatic field and a converging magnetic field, wherein parameters related to the fringing effects in the boundaries of said fields and to the distribution of the electrostatic field reduces image aberrations of the second order.

3 Claims, 12 Drawing Figures

VIRTUAL IMAGE TYPE DOUBLE FOCUSING MASS SPECTROMETER

My invention relates to virtual image type double focusing mass spectrometers or spectrographs and more particularly to mass spectrometers or spectographs incorporating an improved ion optical system capable of reducing the image aberrations of the mass spectra.

Conventional double focusing mass spectrometers use a cylindrical or toroidal electrostatic field to converge the ion beam. In 1964, so-called virtual image type double focusing mass spectrometer equipped with a diverging electrostatic field and a converging magnetic field capable of satisfying double focusing conditions were described at the 12th annual conference of the Mass Spectroscopy Society of Japan. Details of this novel mass spectrometer were also published in the journal issued by said society, Vol. 11, No. 24, 1964pp. 127–140 and Vol. 16, No. 1, 1968 pp. 30–36. Later virtual image type double focusing mass spectrometers were developed and manufactured by the assignee of the present invention.

In order to understand the ion optical system of the virtual image type double focusing mass spectrometer, reference is made to FIG. 1. Ions produced by an ion source (not shown) pass through a main slit 1 and travel towards a diverging electric field 3 as a beam 2 having a transverse dispersion angle $\alpha$ in a plane determined by the central orbit of ions on the electric field (plane $Z=0$). This toroidal diverging electrostatic field has a focusing action similar to that of a concave lens. Accordingly, the ion beam 2 which passes through the main slit 1 with a dispersion angle $\alpha$, enters the converging magnetic field 6 with a greater dispersion angle $\alpha'$ in the plane $Z=0$. Therefore, the ion beam emitted from the diverging electric field 3 travels to the converging magnetic field 6 as if it were emitted from the virtual image point 7. After being converged in the magnetic field 6, the ion beam focuses into a real image at the collector slit 8.

In this ion optical system, the ratio of the transverse dispersion angle $\alpha'$ at the virtual image point 7 to the transverse dispersion angle $\alpha$ at the main slit 1 (i.e., the object point), is equal to the reciprocal of the ratio of the image width $S_0'$ at the virtual image point 7 to the slit width $S_0'$ at the main slit 1. Since $S_0'/S_0$ is equivalent to the image magnification $X_e$(i.e., the ratio of the image width at the object point to the image width at the virtual point), the following relationship is established.

$$\alpha'/\alpha - 1/Xe$$

Appropriate values for the ratio $\alpha'/\alpha$ being 3 ~ 4, the image magnification $X_e$ is one-fourth ~ one-third. From the above elucidation, it would appear apparent that the virtual image type double focusing mass spectrometer incorporates the following features, viz;

1. Improved sensitivity and resolving power up to 3 ~ 4 times is possible due to the fact that a much wider object slit can be used because of the very small image magnification of the spectrometer.

2. Miniaturization of the mass spectrometer is possible due to the fact that the utilization of the virtual image enables the distance between the electrostatic field and the magnetic field to be reduced.

In actual fact, however, the prototype virtual image type double focusing mass spectrometers as developed and manufactured by the assignee of this invention did not come up to expectations as far as resolving power was concerned, since it was found that the concomitant increase in second order image aberrations exercised an adverse effect on resolving power improvement. Factors affecting image aberrations are considered to be the transverse dispersion angle $\alpha$ in the plane determined by the central orbit of ions traveling in the electrostatic field, the longitudinal dispersion angle $\alpha_z$ of the ions passing through the main slit in the r-Z plane which is perpendicular to the $\alpha$ plane and also passes through the apex of the electric field sector, the velocity dispersion $\beta$ of the ions and the longitudinal displacement $b_z'$ at the main slit.

In order to reduce a second order image aberrations caused by the above factors, second order image aberration coefficient in the plane determined by the central orbits of the ions traveling in the electrostatic field were calculated on the basis of the following parameters, viz., re: the radius of curvature of the central orbit of ions in the diverging electric field, rm: the radius of curvature of the central orbit of ions in the converging magnetic field, $\phi e$: the vertical angle of the diverging electric field sector, $\phi m$: the vertical angle of the converging magnetic field sector, $le'$: the distance between the main slit and the entry boundary of the diverging electric field, $d$: the distance between the exit boundary of the diverging electric field and the entry boundary of the converging magnetic field, $lm''$: the distance between the exit boundary of the converging magnetic field and the collector slit, C: the characteristic constant of the diverging electric field.

Moreover, the entry boundary of the magnetic field was shaped into a circular arc having a radius of curvature Rm taking into account the reduction of the aberration created in the entry boundary.

Notwithstanding the efforts to reduce the aberrations, the occurrence of substantial second order aberrations continued to prevail. As a result, I was unable to improve the resolving power of the mass spectra by applying the diverging electrostatic field to a double focusing mass spectrometer. The reason for not being able to reduce the aberrations was due to the difficulties encountered in formulating equations in which said parameters are used in conjunction with the aberrations of the second order or due to the laboriousness in solving said equations. To precisely calculate the second order aberrations based on the equations with the parameters proved to be impossible.

It should be pointed out, however, that parameters which relate either to the aberrations in the plane determined by the central orbit of the ions in the boundaries of the field or to the aberrations outside the aforesaid plane were not taken into consideration when calculating the aberrations even though such parameters do effect the aberrations. I theoretically introduced the general equations pertaining to the influences of the orbits of the charged particles in the boundaries of the magnetic field on the aberrations, and then published the mathematical procedures required to express said general equations in the form of matrixes in the journal "Nuclear Instruments and Methods" Vol. 77, 1970 pp. 40–50 and Vol. 77, 1970, pp. 283–292. I also theoretically introduced the equations concerning the influences of the boundaries of the toroidal electrostatic field on the second order aberrations and published my findings in "Nuclear Instruments and Methods" Vol. 91, 1971, pp. 637–647. However, contents described in those publications merely indicate the influences of the boundaries of the fields on the second order aberrations and do not explain the embodied procedures necessary to calculate the values of said second order aberrations. The evaluation of the influences of the boundaries of the fields (fringing fields) on the aberrations of the second order owing to the aforementioned equations was impracticable.

The toroidal electrostatic field in the plane $Z=0$ determined by the central orbits of the ions is unequal to that outside the plane, as the cylindrical electrostatic field in the plane $Z=0$ is equal to that outside the plane $Z=0$. Therefore, the intensities of the second order aberrations in the toroidal electrostatic field were taken to be stronger than those in the cylindrical electrostatic field. Later, I developed a system of matrixes regarding the effects of the fringing fields and discovered a method utilizing a computer with a certain program to obtain the coefficients of the aberration terms. The results were revealed in the "International Journal of Mass Spectrometry and Ion Physics" Vol. 6, 1971, pp. 385–392. In this literature, the conventional theory that the second order aberrations outside the plane $Z=0$, namely, the aberrations on the ion orbits displaced along Z-axis were extremely small was proven false. The computed results revealed that, even in the electrostatic field, the intensities of the second order aberrations outside the central orbit were considerably large due to fringing effect.

According to the calculated results of the second order aberrations considering the effect of the fringing fields, I indicated in a paper at the fourth conference of "Atomic Masses and Fundamental Constants", held at Teddington, Middlesex, England, in September 1971, that the intensities of the second order aberration of a double focusing mass spectrometer incorporating a converging toroidal electrostatic field were weaker than those of a double focusing mass spectrometer incorporating a cylindrical electrostatic field under appropriate conditions.

It is an object of the present invention to provide a virtual image type double focusing mass spectrometer having a new and improved ion optical system affording a reduction in the aforementioned second order aberrations, in which account is taken of parameters hitherto neglected.

This object can be attained by defining the critical and practical ranges of the parameters which express the fringing effects or the distribution state of the diverging electrostatic field depending on the calculation of the aberrations utilizing the aberration parameters.

In order to understand clearly the theoretical considerations which give rise to the present invention, reference is made to the accompanying drawings of which:

Figure 1:
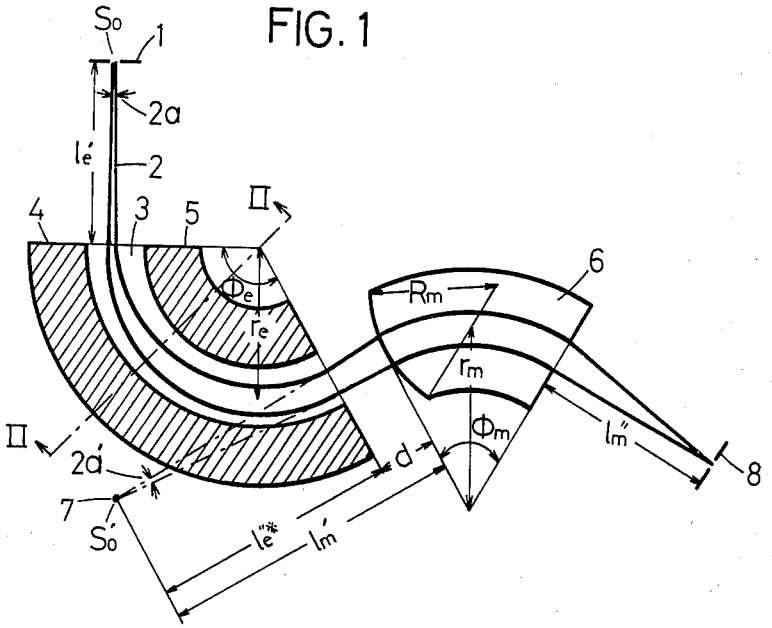
FIG. 1 shows a schematic plane view of the ion optical system according to this invention.
Figure 2:
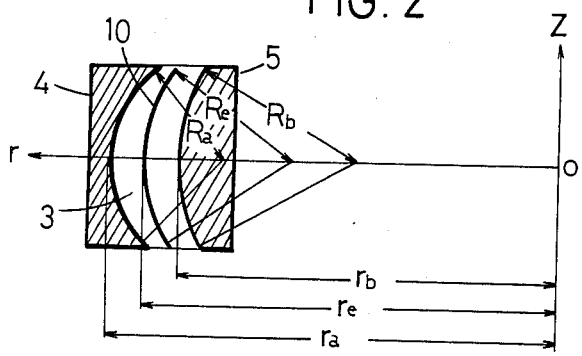
FIG. 2 is a sectional view taken along line II—II of FIG. 1 showing the main geometrical parameters of the diverging electric field.

Hereinafter, the cylindrical coordinates $(r, \phi, Z)$ are used for the mathematical formulation of the aberrations in order to express the ion positions traveling in the diverging electrostatic field 3 as shown in FIGS. 1 and 2. An electrostatic field Eo at any arbitrary point on a circle having a radius $r=re$ in the plane $Z=0$ possesses a constant intensity whose direction faces inwards towards the center of said circle (i.e., perpendicular to the Z-axis). It is here on this circle that the central orbit of the ions is assumed to be located. To examine the electrostatic field around the circle located in the plane $Z=0$, the following equations are used.

$$r=re(1+\rho),\ Z=re\ \zeta(\rho, \zeta<<1)$$

The component of the toroidal electrostatic field Er in the direction of the field can be expressed up to the second order as follows:

$$Er=Eo\ [1-(1+C)\ \rho+\{1+C+C/2\ (1+R')\}\ \rho^2 - C/2\ \{1+C(1+R')\}\ \zeta^2] \quad (1)$$

In the r-Z plane shown in FIG. 2, the radii of curvature of the equipotential lines which pass through an arbitrary point $r$ and a specific point re are assumed to be R and Re respectively. Based on this assumption, $$C=re/Re \quad (2)$$

and $$R'=(dR/dr)\ r=re \quad (3)$$

Where C is a constant indicating the properties of the various electrostatic fields. For example, when $C=0$, $C>0$, $C>2$, $0<C<2$, the electric fields are cylindrical, toroidal, divergent and converging toroidal respectively.

In order to examine the change in the electrostatic field Er around the central orbit of the ions due to orbit displacement along the Z-axis, $\rho$ is assumed to be constant. From the assumption that $C>0$ and $R'>0$ is most cases, it should therefore be understood from equation (1) that the greater $\zeta$ becomes, the weaker $Er$ becomes. And since the ions traveling in an orbit displaced along the Z-axis from the central orbit are located in a weaker electrostatic field than those traveling in the central orbit, their radius of curvature is enlarged. This is just one of the principal causes of the large second order aberrations prevailing in virtual image type double focusing mass spectrometers. In order, therefore, to remove such a cause, the electrostatic field applied to the positions shifted along the Z-axis from the central orbit must be as uniform as possible. Accordingly $\Delta Er/\Delta \zeta$; the derivative of the electrostatic field Er with respect to the displacement along the Z-axis re $\zeta$, should be zero. The following equation can be expressed by utilizing equation (1).

$$1+C(1+R')=0 \tag{4}$$

thus $$R=-(1+1/C) \tag{5}$$

when equation (5) is satisfied, a uniform electric field will be distributed on the positions shifted along the Z-axis from the central orbit. However, satisfying equation (5) is not the only proviso necessary to minimize the above aberrations. The various parameters, especially those related to the fringing effects in the electric and magnetic field boundaries, must also be taken into account. From equation (5), it can be expected that $R'<0$ greatly contributes to reducing the second order aberrations. Assuming that the radii of curvature of the surfaces of the outer and inner electrodes 4 and 5 on each side of the electrostatic field both trimmed in the r-Z plane are Ra and Rb respectively and that the inner electrode is distance rb from the Z-axis, making Ra smaller than Rb would produce an electrode structure such as to create a toroidal electric field having a negative $R'$.

Subsequently, I will explain the aberration coefficients. Assuming the displacement of the ions at the image point to be $Y_B$, the displacement can be expressed up to the second order as follows.

$$YB=rm(B_1\ \alpha+B_2\ \beta+B_{11}\ \alpha^2+B_{12}\ \alpha\beta+B_{22}\ \beta^2+B_{33}\ \alpha z^2+B_{35}\ \alpha z\zeta+B_{55}\ \zeta^2) \tag{6}$$

Where:

- $rm$ is the radius of curvature of the central orbit of the ions in the magnetic field,
- $B_1$, $B_2$ are first order aberration coefficients,
- $B_{11}$, $B_{12}$, $B_{22}$, $B_{33}$, $B_{35}$ and $B_{55}$ are second order aberration coefficients,
- $\alpha$ is the transverse dispersion angle defined hereinbefore,
- $\beta$ is the velocity dispersion mentioned above,
- $\alpha z$ is the longitudinal dispersion angle defined hereinbefore, and
- $\zeta$ is the longitudinal displacement defined hereinbefore.

It is possible to make both the first order aberration coefficients $B_1$ and $B_2$ zero at the same time by making d (the distance between the exit boundary of the electrostatic field and the entry boundary of the magnetic field) and lm'' (the distance between the exit boundary of the magnetic field and the collector slit) satisfy the double focusing conditions. It is also possible to make two of the six second order aberration coefficients zero by selecting R'(defined in equation (3) ) and Rm (the radius of curvature of the boundary surface of the magnetic field) appropriately. And, since in a virtual image type double focusing mass spectrometer, the longitudinal second order aberrations such as $B_{33}$ and $B_{35}$ are quite large, reducing these particular aberrations is especially important. However, since utilizing the diverging electrostatic field has the adverse effect of increasing the dispersion angle $\alpha$, the second order aberration coefficients $B_{22}$, $B_{33}$, $B_{35}$ and $B_{55}$ are calculated hereinafter by making $B_{11}$ and $B_{12}$, both of which are related to transverse angles, zero. The calculation in question is carried out taking into consideration the fringing effects in the fringing fields as well as the various parameters such as $re$, $rm$, $\phi e$, $\phi m$,C, R, Rm etc. relating to the second order aberration coefficients. The parameters and fringing effects are all transformed into matrixes which are formulated into a program suitable for calculation by means of a computer. Depending on the program, each parameter of the ion optical system of a virtual image type double focusing mass spectrometer is calculated so as to make the respective second order aberration coefficients minimum.

Figure 3:
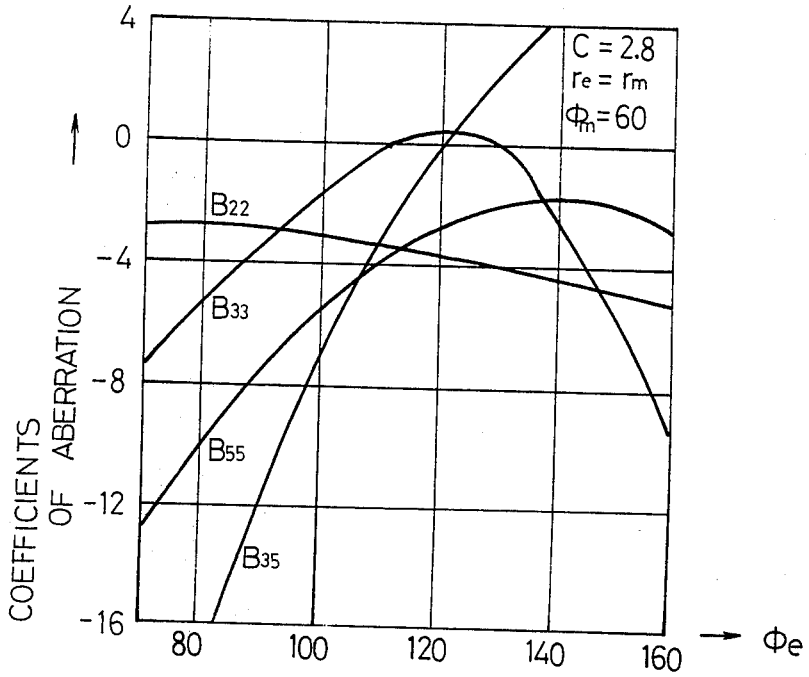
FIGS. 3, 4 and 5 are diagrams showing the characteristic curves of the aberration coefficients with respect to the respective vertical angles $\phi e$ of the electric field sectors having different characteristic constants C.
Figure 4:
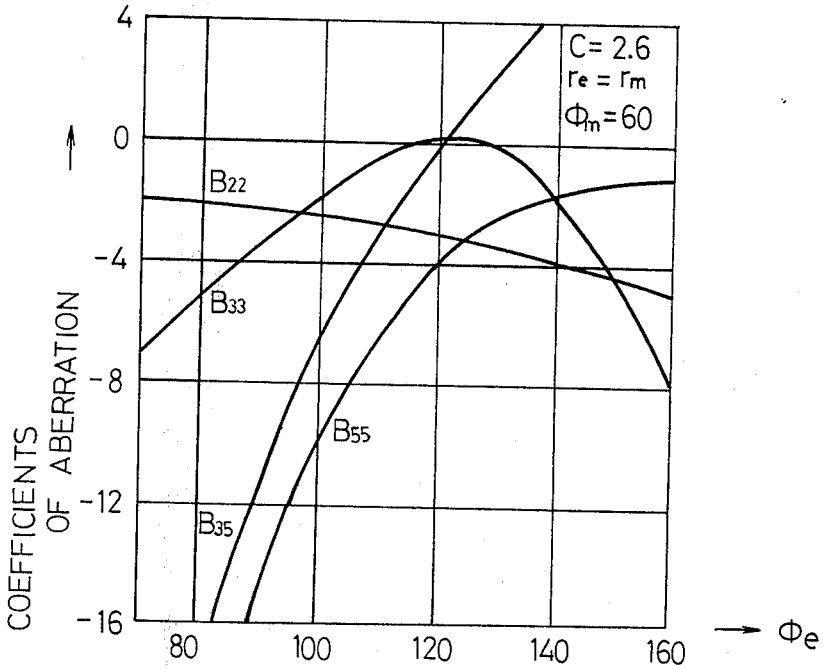
Figure 5:
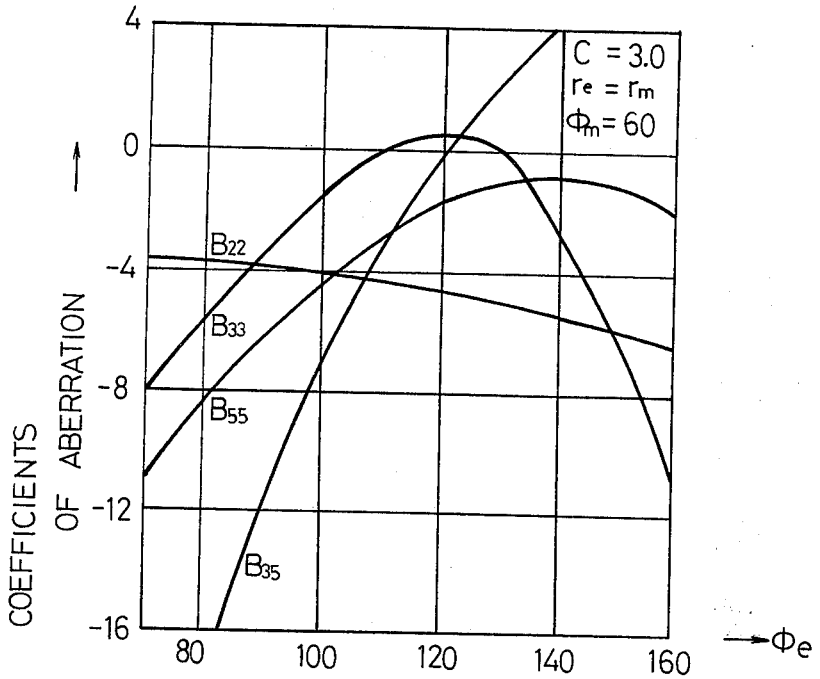
Figure 6:
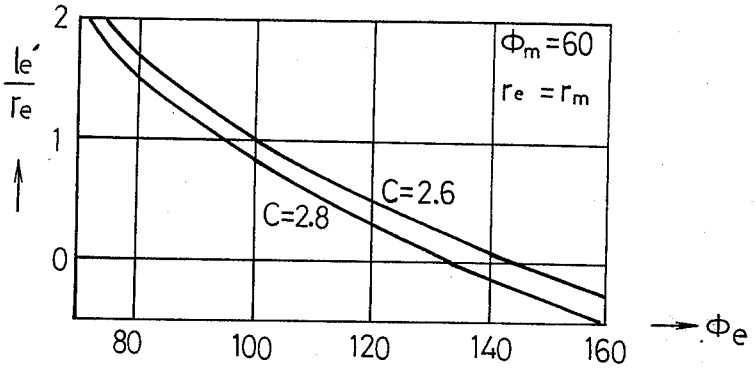
FIG. 6 is a diagram showing the curves of the ratios $le'/re$ with respect to the vertical angle $\phi e$, $le'$ being the distance between the entry boundary and the main slit and $r_e$ being the radius of the central orbit of the ions in the electrostatic field.

FIG. 3 shows the relation between $\phi e$, i.e. the vertical angle of the electrostatic field sector, and the second order aberration coefficients except $B_{11}$ and $B_{12}$ under conditions whereby $C=2.8$, re=rm and $\phi m=60°$. It is apparent from the graph that the aberration coefficients in question are minimal around $\phi e=120°$ and show a sharp increase outside the range $90° \leqq \phi e \leqq 160°$. FIGS. 4 and 5 show the same relationship as in FIG. 3 but at lower and higher C values respectively. In spite of this change, the aberration coefficients remain essentially the same as in the case of $C=2.8$ with the same range, viz., $90° \leqq \phi e \leqq 160°$ critically defining the optimum aberration coefficients. FIG. 6 shows the relation between a given change in $le'$, i.e., the distance between the main slit and the entry boundary of the electrostatic field, and the vertical angle $\phi\ e$ under the conditions whereby $\phi m=60°$ and $re=rm$, where $le'/re$ is read along the longitudinal axis. $Le'/re$ must be at least positive and the space between the main slit and the entry boundary of the electrostatic field must be large enough to accomodate the valve member, the deflection electrodes, the dispersion limiting slit and so on. From FIG. 6 another condition viz., $\phi e \leqq 140°$, can be attained. It therefore follows that the desirable range of the vertical angle of the electrostatic field sector is $90° \leqq \phi e \leqq 140°$.

Figure 7:
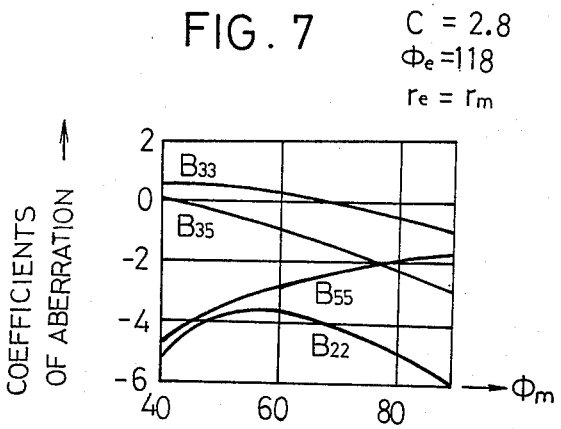
FIG. 7 is a diagram showing the characteristic curves of the aberration coefficients with respect to the vertical angle $\phi m$ of the magnetic field sector.
Figure 8:
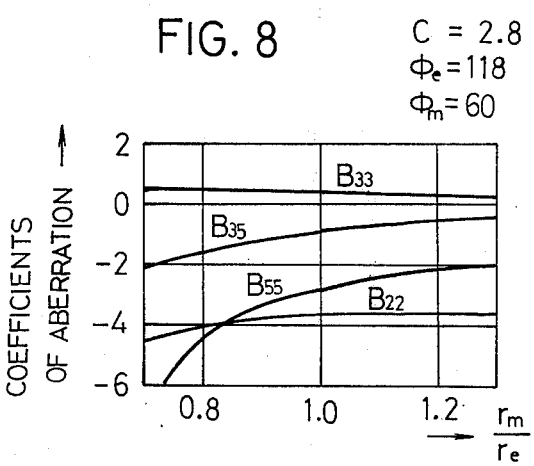
FIG. 8 is a diagram showing the characteristic curves of the aberration coefficients with respect to the ratio $r_m/r_e$, $r_m$ being the radius of the central orbit of the ions in the magnetic field and the apex of the magnetic field sector and $r_e$ being the radius as defined hereinbefore.

FIG. 7 shows the relation between the computer calculated results of the second order aberration coefficients and $\phi m$ indicates that $\phi m$ affects the second order aberration coefficients to a small extent only. FIG. 8 shows the relation between the aberration coefficients and $rm/re$. As in the case of $\phi m$, a change in $rm/re$ has only a slight affect on the second order aberration coefficients. Based on FIG. 8 it is evident that the critical selection of the $\phi e$ range defined by $90° \leqq \phi e \leqq 140°$ should be estimated adequately.

Figure 9:
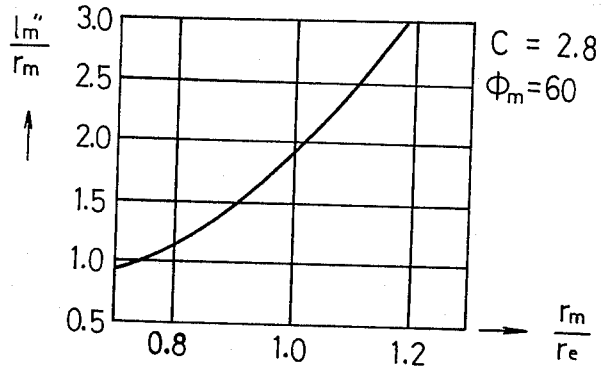
FIG. 9 is a diagram showing the characteristic curve of the ratio of $lm''/rm$ to $rm/re$, $lm''$ being the distance between the exit boundary of the magnetic field and the collector slit.

FIG. 9 shows the relation between $lm''$; 45 i.e. the distance between the exit boundary of the magnetic field and the collector slit, and rm/re under the conditions whereby $C=2.8$, $\phi m=60°$ and $Lm''/rm$ is read along the longitudinal axis. When $rm/re$ exceeds 1.2, $lm''/re$ becomes greater than 3.0. A double focusing mass spectrometer with a too long $lm''$ would bring about a reduction in sensitivity and the apparatus would, of necessity, become bulky. Thus $rm/re < 1.2$ is preferable. FIG. 8 too illustrates that the aberration coefficients have a tendency to assume large values when $rm/re$ is less than 0.8, so that $rm/re > 0.8$ is desirable. In fact, the ideal value of $rm/re$ would almost be one, i.e., the condition whereby $rm \approx re$.

Figure 12:
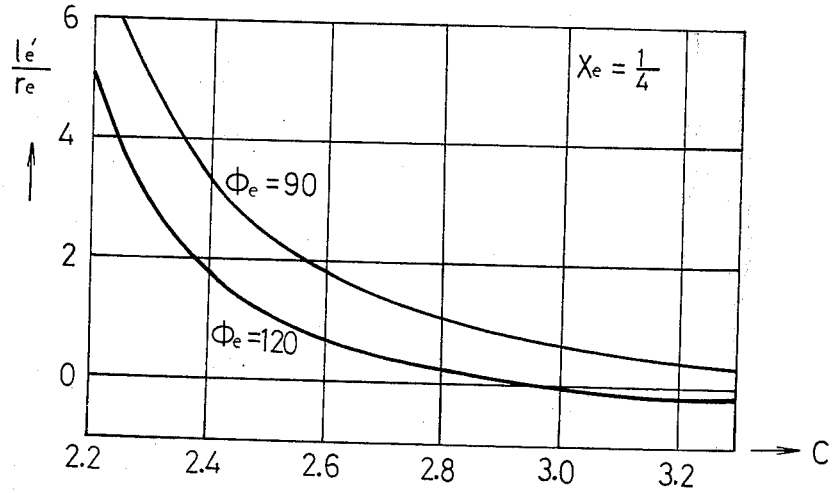
FIG. 12 is a diagram showing the relation between the characteristic curves of the ratio $le'/r$ and the characteristic constant C.
Figure 10:
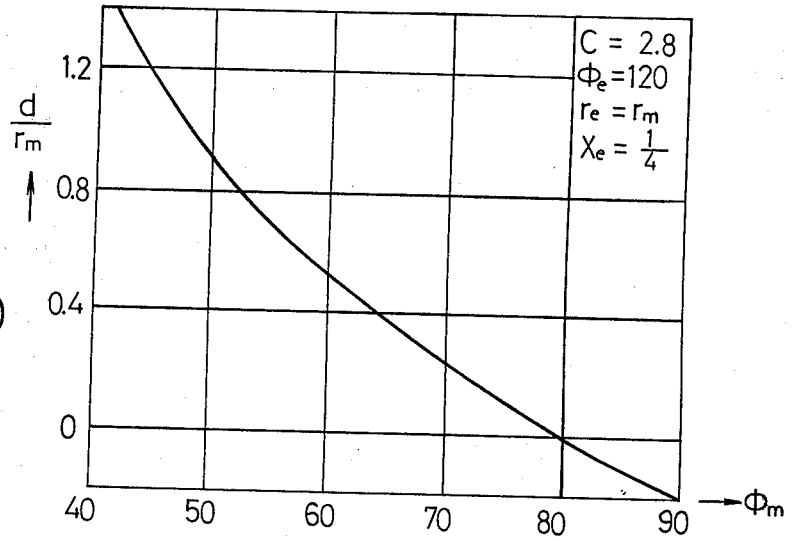
FIG. 10 is a diagram showing the relation between the characteristic curve of the ratio $d/rm$ and the vertical angle $\phi m$, d being the distance as defined hereinbefore.
Figure 11:
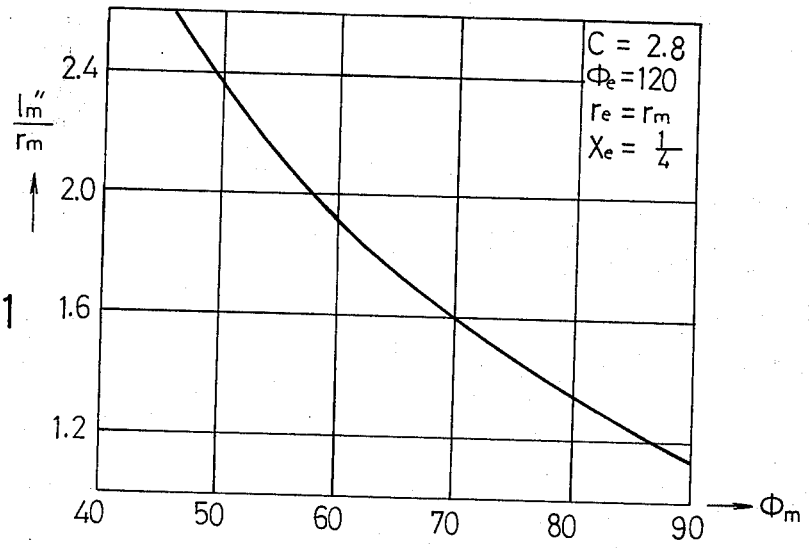
FIG. 11 is a diagram showing the relation between the characteristic curve of the ratio $lm''/rm$ and the vertical angle $\phi m$.

FIG. 10 shows the relation between $d$; i.e. the distance between the exit boundary of the electrostatic field and the entrance boundary of the magnetic field, and $\phi m$, i.e. the vertical angle of the magnetic field sector, under the conditions whereby $C=2.8$, $\phi e=120°$, $re=rm$, $Xe=1/4$, and $d/rm$ is read along the longitudinal axis. When the image magnification in the electrostatic field $Xe$ exceeds $1/2$, $le'$ and $le''$* become too short to design the mass spectrometer and when $Xe$ does not exceed one-fifth, $le'$ and $le''$ become so long that not only does mass spectrometer become bulky but the ion optical system also becomes darker, thereby causing a reduction in sensitivity. Accordingly, $1/4 \leqq Xe \leqq 1/3$ as indicated in the figure gives the best results. Further, at $\phi m=80°$, $d/rm$ is almost zero. However, in order to provide sufficient space to accommodate the monitor slit, etc, $d$ must be greater than zero, thus $\phi m$ must be less than 80°. FIG. 11 shows the relation between $lm''$; i.e., the distance between the exit boundary of the magnetic field and the collector slit, and $\phi m$ under the same conditions as in FIG. 10. The figure indicates that when $lm''/rm$ exceeds 2, the length of $lm''$ increases to such an extent that the ion optical system becomes dark, thereby causing a reduction in sensitivity. Moreover, the mass spectrometer becomes bulky. Accordingly, $\phi m$ must be larger than 50°. Based on FIG. 10 and 11 the usable range of the magnetic field sector vertical angle can be defined as $50° < \phi m < 80°$. Finally, FIG. 12 shows the relation between $le'/re$ and the characteristic constant $C$ under the condition whereby $\phi e=120°$ and $Xe=1/4$. According to the figure, the larger $C$ becomes, the shorter $le'$ becomes until finally $le'$ becoomes negative. Since the realization of a mass spectrometer with a negative $le'$ is out of the question, $C$ must be less than 3.0. However, when $C$ is less than 2.4, $le'$ becomes too large, thus impairing an important feature of this invention, i.e. the miniaturization of the mass spectrometer using a diverging electrostatic field not to mention a striking reduction in sensitivity. Therefore, from the practical point of view, $C$ is preferably defined in the range $2.4 \leqq C < 3.0$.

According to the inventor's calculation which took full consideration of the fringing effects of the boundaries of the electrostatic and magnetic fields, the aberration coefficient $B_{33}$ of a conventional focusing mass spectrometer equipped with a cylindrical electrostatic field was found to be about $-30 \sim -40$. On the other hand, the second order aberration coefficients in the case of the virtual image type focusing mass spectrometer according to this invention is suppressed within the limits ±4, thus enhancing the resolving power to a marked degree. Moreover, the mass spectrometer according to this invention has a comparatively short ion path and virtual image. Consequently, the ion optical system is brighter, the sensitivity is higher and the instrument is small and compact.

Having thus described my invention with the detail and the particularity as required by the Patent Laws, what is desired protected by Letters Patent is set forth in the following claims:

I claim:

1. A double focusing mass spectrometer incorporating a diverging electrostatic field and a converging magnetic field through which an ion beam to be analyzed passes comprising:

a. an ion source for producing an ion beam;

b. inner and outer electrodes for producing the diverging electrostatic field, positions within said field being defined by the cylindrical coordinates $r$, $\phi$ and $z$, the central ion orbit having a radius $r_e$ in the $z=0$ plane, equipotential lines within said field in the $z=0$ plane being defined by a particular value of $r$, equipotential lines within said field in an r-z plane which contains the z axis and thereby being perpendicular to the central ion orbit being defined by a radius R, said field satisfying the condition $$\frac{dR}{dr} < 0,$$

the ratio of the radius $r_e$ of the central ion orbit and $R_e$ being the radius of curvature of an equipotential line in the r-z plane passing through the central ion orbit satisfying the following range $$2.4 \leqslant r_e/R_e \leqslant 3.0$$

and the vertical angle of $\phi_e$ of the electric field satisfying the range $90° \leqslant \phi_e \leqslant 140°$;

c. means for producing the converging magnetic field so as to converge the ions emitted from the electrostatic field; and d. means for detecting the ions converged by the magnetic field.

2. In a double focusing mass spectrometer as set forth in claim 1 wherein said means for producing the converging magnetic field defines a sector and comprises the optical parameters which satisfy the following relation and range:

$r_m$ is nearly equal to $r_e$ and $50° < \phi m < 80°$, where $r_m$ is the radius of curvature of the central orbit of the ions in said magnetic field and $\phi m$ is the vertical angle of the magnetic field sector.

3. A double focusing mass spectrometer as set forth in claim 1 wherein the radius of curvature of the surface on the electrostatic field side of the outer electrode trimmed by the r-Z plane is smaller than the radius of the curvature of the surface on the electrostatic field side of the inner electrode trimmed by the r-Z plane, so as to make the derivative dR/dr negative.

* * * * *

UNITED STATES PATENT OFFICE

CERTIFICATE OF CORRECTION

PATENT NO. : 3,944,827

DATED : March 16, 1976

INVENTOR(S) : Hisashi Matsuda

It is certified that error appears in the above-identified patent and that said Letters Patent are hereby corrected as shown below:

Column 1 Line 48 "$S'_0$" (first occurrence) should read --$S_0$--.

Column 6 Line 65 Delete the numeral --45--.

Signed and Sealed this

*twenty-fifth* Day of *May 1976*

[SEAL]

*Attest:*

RUTH C. MASON
*Attesting Officer*

C. MARSHALL DANN
*Commissioner of Patents and Trademarks*